US005242349A

United States Patent [19]

Reiff et al.

[11] Patent Number: 5,242,349

[45] Date of Patent: Sep. 7, 1993

[54] ARM EXERCISE APPARATUS

[76] Inventors: Meredith G. Reiff; Barbara A. Bowen, both of 2407 Eugene St., Sarasota, Fla. 34231

[21] Appl. No.: 921,070

[22] Filed: Jul. 29, 1992

[51] Int. Cl.[5] ..... A63B 21/00

[52] U.S. Cl. ..... 482/106; 482/50; 482/108; 42/1.08; 273/84 R

[58] Field of Search ..... 273/84 R, 84 ES, 72 R, 273/67 R; 482/49, 50, 106, 108; 42/1.08

[56] References Cited

U.S. PATENT DOCUMENTS

| | | | |
|---|---|---|---|
| 4,037,839 | 7/1977 | Nelson | 273/84 R |
| 4,441,707 | 4/1984 | Bosch | 482/131 |
| 4,449,474 | 5/1984 | Mariol | 42/1.08 |
| 4,486,807 | 12/1984 | Yanez | 273/84 ES |
| 4,610,447 | 9/1986 | Byrd | 482/74 |
| 4,627,618 | 12/1986 | Schwartz | 482/108 |
| 5,086,377 | 2/1992 | Roberts | 273/84 R |
| 5,135,454 | 8/1992 | Yeh | 482/108 |

FOREIGN PATENT DOCUMENTS

| | | | |
|---|---|---|---|
| 8605868 | 10/1986 | World Int. Prop. O. | 273/84 ES |

*Primary Examiner*—Richard J. Apley
*Assistant Examiner*—D. Maraglio
*Attorney, Agent, or Firm*—Gifford, Groh, Sprinkle, Patmore & Anderson

[57] ABSTRACT

Arm exercise apparatus in the form of dumbbells having a hand hold portion and ball weight members at opposite ends of the hand hold portion to form a housing containing self defense means. In one embodiment the self defense means is an extensible portion forming a club, in another embodiment the mechanism forms an audible alarm and in still another embodiment the housing holds a canister of debilitating gas which can be released on demand.

6 Claims, 1 Drawing Sheet

ARM EXERCISE APPARATUS

This invention relates to arm exercise apparatus and more particularly to such arm exercise apparatus which incorporates self defense means.

Joggers and runners frequently use arm weights to increase the muscular effort required during running and jogging. Jogging and running often occurs during early morning or late evening hours when traffic and other activity is at a minimum. Furthermore, runners and joggers frequently exercise in more remote areas to avoid traffic and congestion. Because of this isolation it becomes desirable to be in a position to defend in the event the exerciser is confronted by attackers.

SUMMARY OF THE INVENTION

It is an object of the invention to provide arm exercise equipment to be used by runners or joggers which incorporates a self defense mechanism.

It is a further object of the invention to provide exercise equipment in which the self defense mechanism is in the form of an extensible dumbbell which offers a club for fending off attackers.

Another object of the invention is to provide an exercise mechanism incorporating a self defense mechanism in the form of an audible alarm which may be activated in the event the user is subject to an attack.

Another object of the invention is to provide arm exercise apparatus incorporating self defense means in the form of a tear gas or nerve gas which may be released in the direction of an attacker.

It is still another object of the invention to provide a set of exercise apparatus incorporating different forms of self defense mechanisms, a pair of which may be selected for use by the exerciser.

The objects of this invention are accomplished by arm exercise apparatus in the form of a dumbbell structure having a handle portion and a pair of weight members supported on opposite ends of the handle portion. The handle and weight members form a hollow housing for containing or storing self defense means.

In one embodiment of the invention, the self defense means is in the form of an extensible member which telescopes into a hollow handle portion for storage and is released from its storage position to move to an extended position upon the actuation of a control button. In the actuated position the arm exercise apparatus forms an elongated club member.

In another embodiment of the invention the self defense means is in the form of an audible alarm mechanism which is housed within the hollow housing member formed by the handle and the weight members.

In still another embodiment of the invention self defense means is in the form of a gas such as tear gas or a nerve gas contained within a canister within the housing from which it can be released in the direction of the attacker.

In all of the embodiments of the invention the self defense means are activated by a control button positioned near the thumb of the user for easy access but at the same time avoiding accidental activation.

DESCRIPTION OF THE PREFERRED EMBODIMENTS

Figure 1:
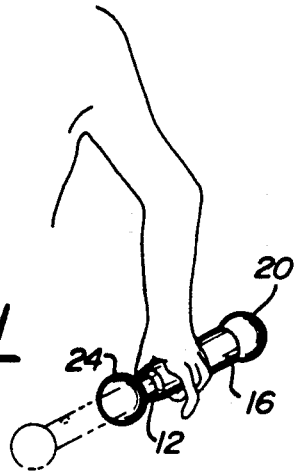
FIG. 1 is a perspective view showing an embodiment of the invention positioned in the hand of a user.
Figure 2:
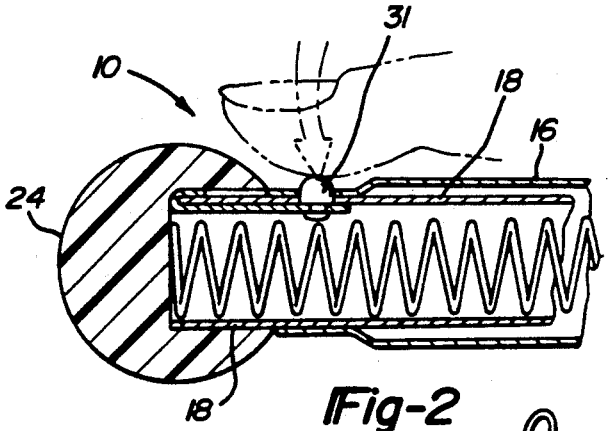
FIG. 2 is a cross-sectional view at an enlarged scale with parts broken away to show one end of the embodiment of FIG. 1.
Figure 3:
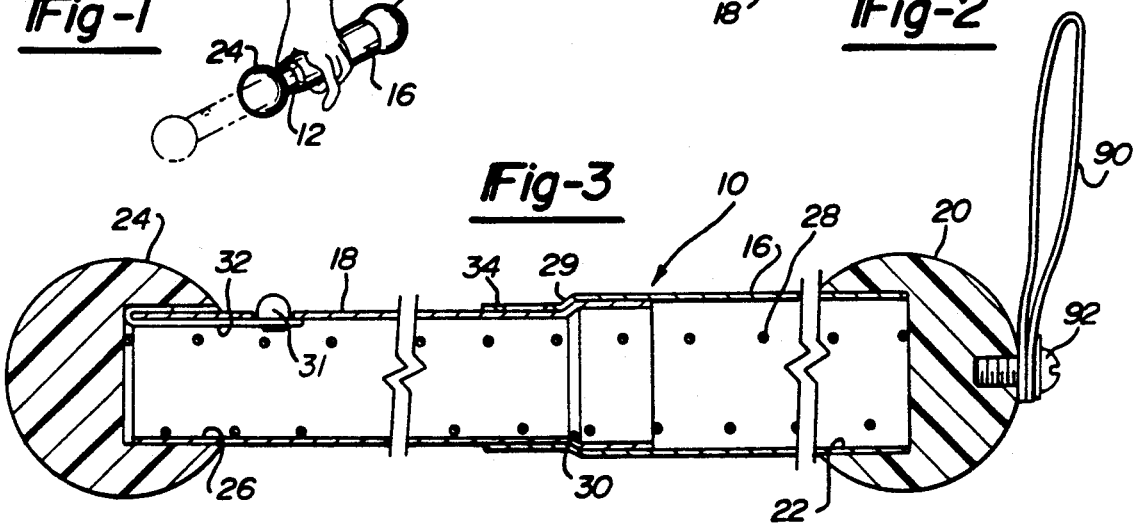
FIG. 3 is a cross-sectional view of the arm exercise apparatus in an extended position.

Referring to the drawings and particularly FIGS. 1 through 3, the exercise apparatus embodying the invention is designated generally at 10 and includes a cylindrical hand hold 12, the opposite ends of which are provided with spherical weights. Such a structure is commonly referred to as a dumbbell and is intended to be held by a user to exercise the arms by imposing loads on the muscles during movement of the arms.

In the embodiment shown in FIGS. 1 through 3 the cylindrical hand hold 12 is in the form of tubular member 16 which telescopically receives a tubular member 18. One end of tube 16 is provided with a spherical ball 20 which is press fitted or otherwise fastened in a bore 22 formed in the ball 20. Similarly, the tube 18 is fitted with a ball 24 having a bore 26 to receive the end of the tube 18. The balls 20 and 24 form the spherical weight portions of the dumbbell.

Disposed coaxially of the tube 16 and 18 is a spring 28 which serves to maintain the balls 20 and 24 in spaced apart relationship when the tube 16 and 18 are extended relative to each other. The extended position of the tubes 16 and 18 shown in FIG. 3 is determined by stepped portion 29 at the end of tube 16 opposite to ball 20 which is complementary with a stepped portion 30 at the end of tube 18, opposite ball 24. The stepped portions 29 and 30 engage each other to limit the extended position.

During use as exercise apparatus, the tube 16 and 18 are collapsed relative to each other against the action of the resilient spring 28 and are held in the collapsed or storage position as shown in FIG. 2 by a push button 31. The push button 31 is attached to a portion of a leaf spring 32 held in position in the interior of tube 18 adjacent to ball 24. In the collapsed position of the tubes 16 and 18 shown in FIG. 2, the push button 31 projects through an opening in tube 16 at the end opposite to ball 20. Push button 31 holds the tubes 16 and 18 fixed against the action of the compressed spring 28. When it is desired to extend the dumbbell 10 to the condition illustrated in FIG. 3 or in broken lines in FIG. 1, the button 31 is depressed by the thumb against the action of spring 28 to clear the opening and the spring 28 causes the tubes 16 and 18 to extend relative to each other. The result is that the tube 16 remains in the users hand and tube 18 projects from tube 16. In the extended position shown in FIG. 3, the dumbbell 10 forms a club-like weapon for use by the exerciser to ward off an attacker. In the FIG. 2 position, the tubes 16 and 18 are collapsed to permit dumbbell 10 to operate as an ordinary weight for exercise purposes.

Figure 4:
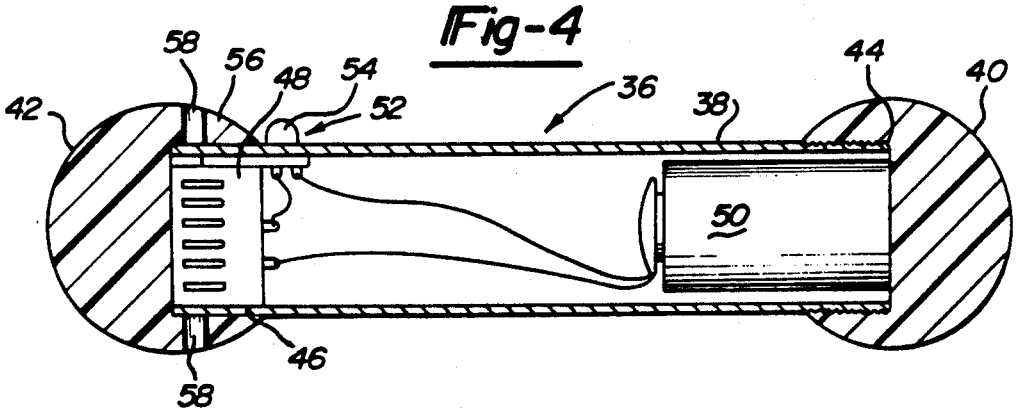
FIG. 4 is a cross-sectional view of another embodiment of the invention incorporating an audible alarm.

Another embodiment of the invention is shown in FIG. 4 in which the dumbbell is designated generally at 36 and includes a cylindrical handhold in the form of a tube 38. Opposite ends of the tube 38 are fitted with balls 40 and 42 which are press fit or otherwise fastened in bores 44 and 46, respectively. One end of the tube 38 is provided with an audible alarm or horn 48 of the type found in smoke alarms. The horn 48 is powered by a battery 50 disposed in the other end of the tube 38. Actuation of the horn 48 is by way of a switch 52 mounted at one end of the tube 38 and having a control button 54 protruding through the cylindrical wall of tube 38. To activate the horn 48, the button 54 is moved to close the contacts of a switch 52 in a circuit including the battery 50 and horn 48. The ball 42 is provided with a plurality of radial passages 58 for emission of sound from the horn 48 radially outwardly of the tube 38.

Figure 5:
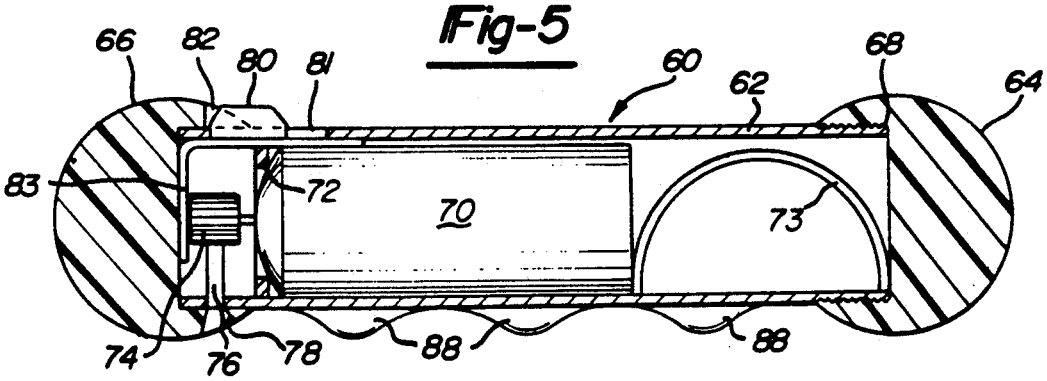
FIG. 5 is a cross-sectional view of still another embodiment of the invention incorporating a canister of gas.

Still another embodiment of the invention is illustrated in FIG. 5 in which a dumbbell is designated generally at 60 and has an outward appearance generally similar to the dumbbells 10 and 36 of the other embodiments of the invention. The dumbbell 60 includes a tubular handhold 62, the opposite ends of which are fitted with balls 64 and 66. The ball 64 is generally similar to the balls 40 and 20 and is provided with a bore 68 to receive one end of the tube 62. The ball 66 is modified to accommodate an aerosol canister 70 containing gas.

The gas canister 70 may be an aerosol container containing gas such as tear gas or a tear gas in combination with an ultra violet sensitive dye for suspect identification. Such a product is manufactured by Qualco Products Co., Fanwood, N.J. Another form of gas is available under the trademark MACE which is used for a chemical compound in aerosol containers that has the combined effect of tear gas and nerve gas to temporarily stun victims.

The canister 70 is located at one end of tube 62 and is held in position in the tube by being urged against an annular seat 72 by a leaf spring 73 acting between one end of the canister 70 and the ball 62.

The canister 70 is provided with a conventional actuating element 74 which is depressed to direct contents of the canister 70 radially outwardly through a tube 76 positioned in an opening 78 formed in the end of tube 62 and in the ball 66. The actuating element 74 is depressed by a slide button 80, slidable in the slot 81 formed in the wall of tube 62. The slide button 80 is positioned diametrically opposite the opening 78 and in its inoperative position is at least partially seated in a recess 82 formed in ball 66. Upon sliding of the slide button 80 out of the recess 82, a prong 83 attached to the button 80 is moved axially of tube 62 to press on the actuating element 74, causing gas to be expelled from the canister 70 and through the tube 76 and opening 78.

The dispensing tube 76 for expelling the gases from the canister 70 is in position diametrically opposite to the slide button 80. The thumb of the user holding the hand grip of the dumbbell 60 typically will be toward the user which will position the outlet of the dispensing tube away from the user. To further assist orienting the dumbbell 60 in the hand of the user so that the slide button 80 is positioned adjacent to the thumb, finger grips 88 may be provided on the tubular member 62. Similarly to orient the push button 31 and slide button 54 of the other embodiments, similar finger grips may be provided.

As shown in FIG. 3, the ball 20 can be provided with a thong 90 held in position relative to the ball 20 by a screw 92. The thong 90 is intended to fit around the wrist of the user so that upon releasing the grip on the handhold 12, the dumbbell 10 will remain connected to the user. The balls 40 and 62 associated with the other embodiments of the invention can be provided with similar thongs for this purpose.

For the purpose of replacing the battery in FIG. 4 and the gas canister in FIG. 5, the respective balls 40 and 62 may be detachably connected to the handholds by complementary threads.

Joggers will typically use a pair of dumbbells, one in each hand. It is intended that a user will have access to all three embodiments of the invention and that a selected pair of dumbbells from a group which includes the extensible dumbbell 10 shown in FIGS. 1 through 3, the audible alarm dumbbell 36 shown in FIG. 4 or the gas dumbbell 60 shown in FIG. 5. By way of examples, the jogger might choose to use the audible alarm of FIG. 4 and the gas canister of FIG. 5 or any of the two remaining combination of pairs of dumbbells.

Preferably each of the dumbbells is made of plastic materials. Although, it will be understood that other materials such as tubular metals and cast balls could be used.

Arm exercise apparatus have been provided in the form of dumbbells which form housings acting to contain self defense means such as an extensible member acting to form a club, an audible alarm or a debilitating gas. A selected embodiment may be used in one hand and another embodiment in another to give the jogger using the arm exercise apparatus a selection of means for protecting themselves from attackers.

We claim:

1. Arm exercise apparatus comprising:

a dumbbell structure including a handle portion and a pair of weight members supported on opposite ends of said handle portion, said handle portion forming a hollow housing member, self defense means disposed in said housing, and means to selectively activate said self defense means including a control button positioned adjacent one of said weight members and recessed in said one weight member in an inactive position of said control button.

2. The combination of claim 1 wherein said control button is displaced longitudinally of said handle away from said one weight member.

3. The combination of claim 1 wherein said weight members and said handle forming a hollow housing member are made of plastic.

4. Arm exercise apparatus comprising:

a dumbbell structure including a handle portion and a pair of weight members supported on opposite ends of said handle portion, said handle forming a hollow housing member, self defense means including a gas in a container supported in said housing member, said gas container being in communication with a conduit extending generally radially from one of said weight members, and means for selectively actuating said self defense means.

5. The combination of claim 4 wherein said actuating means is disposed adjacent said one weight member.

6. The combination of claim 5 wherein an exhaust portion for said gas container is diametrically opposite said actuating means.

* * * * *